US009322232B2

(12) United States Patent
Rajabi et al.

(10) Patent No.: US 9,322,232 B2
(45) Date of Patent: Apr. 26, 2016

(54) SYSTEM AND METHOD FOR INHIBITING AN EXPLOSIVE ATMOSPHERE IN OPEN RISER SUBSEA MUD RETURN DRILLING SYSTEMS

(71) Applicant: AGR Subsea, A.S., Straume (NO)

(72) Inventors: Mehdi M. Rajabi, Bergen (NO); Bjorn Rohde, Hjelllestad (NO); Roger Sverre Stave, Straume (NO)

(73) Assignee: AGR SUBSEA, A.S., Straume (NO)

( * ) Notice: Subject to any disclaimer, the term of this patent is extended or adjusted under 35 U.S.C. 154(b) by 0 days.

(21) Appl. No.: 14/348,583

(22) PCT Filed: Oct. 2, 2012

(86) PCT No.: PCT/IB2012/002339

§ 371 (c)(1),
(2) Date: Mar. 28, 2014

(87) PCT Pub. No.: WO2013/050872

PCT Pub. Date: Apr. 11, 2013

(65) Prior Publication Data

US 2014/0224542 A1 Aug. 14, 2014

Related U.S. Application Data

(60) Provisional application No. 61/542,963, filed on Oct. 4, 2011.

(51) Int. Cl.
*E21B 43/38* (2006.01)
*E21B 21/08* (2006.01)
(Continued)

(52) U.S. Cl.
CPC ..... *E21B 21/08* (2013.01); *E21B 21/001* (2013.01)

(58) Field of Classification Search
None
See application file for complete search history.

(56) References Cited

U.S. PATENT DOCUMENTS 7,027,968 B2 * 4/2006 Choe et al. ..... 703/10
7,093,662 B2 * 8/2006 deBoer ..... 166/358
(Continued)

FOREIGN PATENT DOCUMENTS

WO 0039431 A1 7/2000
WO 0075477 A1 12/2000

OTHER PUBLICATIONS

Notification of Transmittal of the International Search Report and the Written Opinion of the International Searching Authority of PCT/IB2012/002339, Dec. 10, 2013.
(Continued)

*Primary Examiner* — Matthew R Buck
*Assistant Examiner* — Douglass S Wood
(74) *Attorney, Agent, or Firm* — Richard A. Fagin; Adenike Adebiyi

(57) ABSTRACT

A method for inhibiting an explosive atmosphere in a wellbore drilling system, including a riser (12) connected to a wellbore above a top thereof wherein the riser has a fluid outlet (17) below a surface of a body of water in which the wellbore is drilled, and wherein the fluid outlet is connected to a subsea pump to return drilling fluid to a drilling platform on the water surface and wherein a space in the riser (12) above the drilling fluid level filled with air includes pumping drilling fluid into a drill string (15) extending from the drilling platform into the wellbore. Fluid (27) is introduced proximate an upper end of the riser (12). A rate of introducing the fluid (27) is selected to inhibit an explosive atmosphere in the space in the riser above the drilling fluid level. The subsea pump to remove fluid from the riser outlet is operated at a rate selected to maintain the fluid level or to maintain a selected wellbore pressure.

4 Claims, 3 Drawing Sheets

(51) Int. Cl.
*E21B 33/06* (2006.01)
*E21B 21/00* (2006.01)

(56) References Cited

U.S. PATENT DOCUMENTS

| | | | | |
|---|---|---|---|---|
| 7,677,329 | B2 | 3/2010 | Stave | |
| 8,978,774 | B2 * | 3/2015 | Fossli | E21B 21/001 166/347 |
| 2004/0065440 | A1 | 4/2004 | Farabee et al. | |
| 2011/0061872 | A1 | 3/2011 | Mix et al. | |

OTHER PUBLICATIONS

Grace, R.D., Cudd, B., Carden, R.S., Shursen J.L., 2003, Blowout and Well Control Handbook, 262-270. Gulf Professional Publishing.
Stein, B., Elfrink, E.B., Wiener, L.D. And Sandberg, C.R., 1952, The Slip Velocity of Gases Rising through Liquid Columns, 233-240; Trans., AIME.

* cited by examiner

SYSTEM AND METHOD FOR INHIBITING AN EXPLOSIVE ATMOSPHERE IN OPEN RISER SUBSEA MUD RETURN DRILLING SYSTEMS

BACKGROUND

Subsea mudlift pump drilling is used in sub-bottom wellbore drilling in selected water depths to enable maintaining a fluid pressure and pressure gradient in the wellbore that is different than would be the case with conventional drilling, wherein drilling fluid pumps located on a drilling unit above the water surface pump drilling fluid into the well at such rates and pressures as to enable lifting the drilling fluid all the way from the bottom of the wellbore and back to the drilling unit above the water surface. As is known in the art, in conventional drilling the fluid pressure in the wellbore and pressure gradient are related to the pressure of the drilling fluid being pumped at the surface, the depth of the wellbore and the specific gravity ("mud weight") of the drilling fluid.

It is known in the art to use a pump in the drilling fluid return line to the drilling unit above the water surface to reduce the fluid pressure and pressure gradient in the wellbore annulus (the space between the drill string and the wall of the wellbore) so that drilling may proceed to greater depths before the need to set a protective liner or casing in the wellbore. Such "subsea mudlift drilling" techniques may enable having a larger diameter wellbore at the planned total wellbore depth because fewer concentrically placed protective casings or liners may be needed than when using conventional drilling techniques. One example of such technique is described in U.S. Pat. No. 7,677,329 issued to Stave and incorporated herein by reference. One limitation to subsea mudlift pump systems such as those described in the Stave patent is that the upper portion of the drilling riser is open, and is frequently filled with air above the maintained level of drilling fluid in the riser. While essentially all drilling fluid pumped into the wellbore is returned to the drilling unit by the subsea mudlift pump, safety considerations suggest the need to ensure that an explosive atmosphere, caused by entrained wellbore gas in the returning drilling fluid entering the air-filled portion of the riser through the open wellbore connection to the riser, does not come into existence.

What is needed is a system for inhibiting accumulation and/or maintenance of explosive atmospheres in open top risers using subsea mudlift systems such discussed above.

SUMMARY

A method for inhibiting an explosive atmosphere in a wellbore drilling system including a riser connected to a wellbore above a top thereof wherein the riser has a fluid outlet below a surface of a body of water in which the wellbore is drilled, and wherein the fluid outlet is connected to a subsea pump to return drilling fluid to a drilling platform on the water surface and wherein a space in the riser above the drilling fluid level in the riser filled with air includes pumping drilling fluid into a drill string extending from the drilling platform into the wellbore. Fluid is introduced proximate an upper end of the riser. A rate of introducing the fluid is selected to inhibit an explosive atmosphere in the space in the riser above the drilling fluid level therein. The subsea pump is operated to remove fluid from the riser outlet at a rate selected to maintain the fluid level in the riser or a selected wellbore pressure.

Other aspects and advantages related to this disclosure will be apparent from the description and claims which follow.

DETAILED DESCRIPTION

Figure 1:
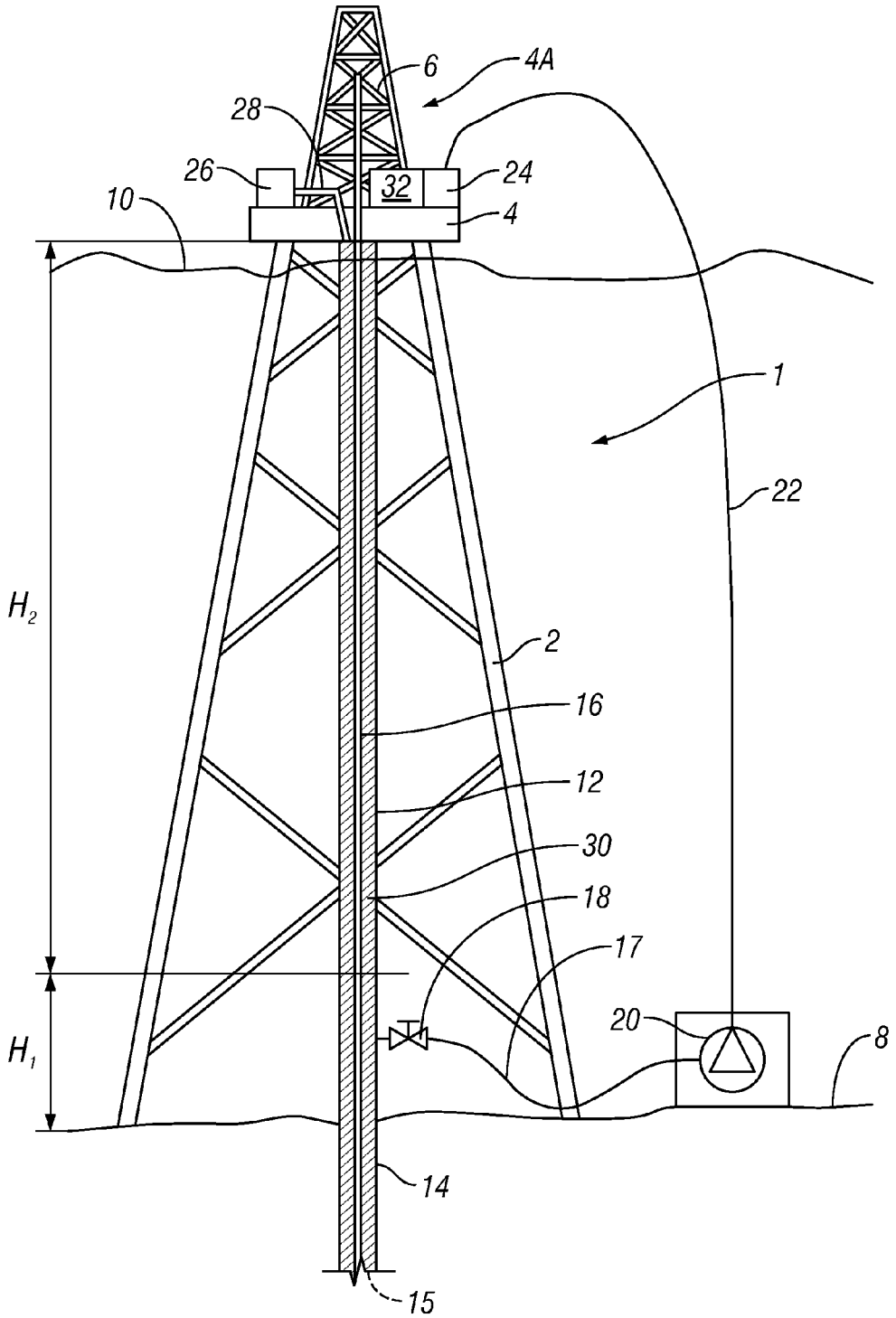
FIG. 1 shows an example of a subsea mudlift drilling system with a subsea mudlift pump below the surface of a body of water in which a wellbore is being drilling.

Referring to FIG. 1, when drilling from a fixed (bottom supported) platform or floating drilling platform 4A (either referred to as a "drilling rig") near the surface 10 a body of water, a conductor pipe (not shown separately) is first installed into the water bottom. When drilling a wellbore 15 from the drilling rig 4A, drilling fluid is pumped through a drill string 16, supported and moved by suitable equipment on a derrick 6 disposed on the rig 4A. The drilling fluid may be pumped, e.g., by main rig "mud" pumps 32, down to a drilling tool (not shown), typically terminating in a drill bit (not shown) that cuts through the formations (below water bottom 8) to lengthen the wellbore 15. The drilling fluid serves several purposes, of which one is to transport drill cuttings out of the borehole, and to maintain fluid pressure in the wellbore 15 to prevent collapse of the wellbore and prevent entry of fluids into the wellbore 15 from exposed formations. Efficient transport of drill cuttings may be conditioned on the drilling fluid being relatively viscous. The drilling fluid flows back through an annulus 30 between the wellbore wall, a liner or casing 14 and the drill string 16, and up to the drilling rig, where the drilling fluid is treated and conditioned before being pumped back down into the wellbore 15. In many cases, the combined pressure of pumping and the selected density of the drilling fluid will result in a head of pressure and/or pressure gradient in the wellbore annulus 30 that is undesirable.

By coupling a subsea mudlift pump 20 to the liner 14 near the water bottom 8 (or to the wellhead when drilling, e.g., from a floating drilling rig or ant any other convenient location beneath the water surface), the returning drilling fluid can be pumped out of the annulus 30 and up to the drilling rig 4 to reduce the fluid pressure in the annulus 30. In some implementations, the annular volume above the wellbore may include a riser 12 that may be partially or completely filled with drilling and/or with a riser fluid. The density of the riser fluid may be less than that of the drilling fluid. It is also possible to drill such wellbores without a riser by using a rotating control head or rotating diverter at the top of the wellbore (wellhead) to seal against the drill string 16. In the present example, a riser is used, and the riser fluid may be air.

The drilling fluid pressure at the level of the water bottom 8 may be controlled from the drilling rig by selecting the inlet pressure to the subsea mudlift pump 20. In riser type drilling systems as shown in FIG. 1, the height $H_1$ of the column of drilling fluid above the water bottom 8 depends on the selected inlet pressure of the subsea mudlift pump 20, the density of the drilling fluid and the density of the riser fluid and the relative levels of each such fluid in the riser 12. The inlet pressure of the pump 20 is equal to: $P=(H_1\gamma_b)+(H_2\gamma_s)$ in which $\gamma_b$ represents the density of the drilling fluid, $H_1$ represents the height of the drilling fluid, $H_2$ represents the height of the column of riser fluid (e.g., air), and .$\gamma_s$ represent the density of the riser fluid.

$H_1$ and $H_2$ together make up the length of the riser 12 section from the water bottom 8 and in some examples extend up to the deck of the drilling rig 4A. Filling the riser 12 at least in part with the riser fluid (e.g., air) allows continuous flow quantity control of the fluid flowing into and out of the wellbore 15. Thus, it is relatively easy to detect a phenomenon, such as, for example, drilling fluid flowing into an exposed formation. It is furthermore possible to maintain a substantially constant drilling fluid pressure at the level of the water bottom 8 when the drilling fluid density changes. Choosing a different inlet pressure to the subsea mudlift pump 20 will rapidly cause the heights $H_1$ and $H_2$ to change according to the new selected wellbore annulus 30 pressure. If so desired, the outlet 17 from the annulus 30 to the subsea mudlift pump 20 can be arranged at a level below the water bottom 8, for example by coupling a first pump pipe (not shown) to the annulus 30 at a level below the water bottom 8. In order to prevent the drilling fluid pressure from exceeding an acceptable level (e.g. in the case of a pipe "trip"—that is, complete removal and reinsertion of the drill pipe string 16 from the wellbore 15), the riser 12 may be provided with a dump valve (not shown). A dump valve (not shown) of this type may be set to open at a particular pressure for outflow of drilling fluid to the body of water 1.

In FIG. 1, reference number 1 denotes the body of water. The drilling rig 4A may comprise a support structure 2 (if the rig 4A is bottom supported), a deck 4 and the derrick 6. The support structure 2 if used is placed on the water bottom 8 and projects above the water surface 10. As explained above the deck 4 may also be supported by a floating platform (not shown). The riser 12 may extends from the water bottom 8 or a subsea wellhead (not shown) up to the deck 4, while the liner 14 may extend further down into the wellbore 15. The riser 12 may be provided with certain required well head valves (not shown). The drill string 16 when disposed in the wellbore 15 extends from the deck 4 and down through the liner 14.

A first subsea mudlift pump pipe 17 may be coupled to the riser section 12 near the water bottom 8 through a valve 18 and the opposite end portion of the pump pipe 17 is coupled to the intake of the subsea mudlift pump 20. In the present example the subsea mudlift pump 20 may be placed near the water bottom 8. A second pump pipe 22 extends from the pump 20 up to a collection tank 24 for drilling fluid on the deck 4 (not shown are devices such as "shale shakers" and degassers to treat the returning fluid before disposition into the tank 24). A tank 26 for a riser fluid communicates with the riser section 12 via a connecting pipe 28 at the deck 4. The connecting pipe 28 may have a volume meter (not shown). The density of the riser fluid may be less than that of the drilling fluid, as explained above, or it may be drilling fluid. The power supply for the subsea mudlift pump 20 may be provided by an electrical cable (not shown) or hydraulic lines (not shown) extending from the drilling rig 4A, and the pressure at the inlet to the subsea mudlift pump 20 may be selected by control (automatic or manual) from the drilling rig 4A of the operating speed of the pump 20.

The drilling fluid is pumped down through the drill string 16 in a manner that is known in the art, and returns to the deck 4 via the annulus 30 between the liner 14 and the drill string 16. When the subsea mudlift pump 20 is started, the drilling fluid is returned from the annulus 30 via the subsea mudlift pump 20 to the collection tank 24 on the deck 4.

While the example shown in FIG. 1 has the subsea mudlift pump 20 disposed near or on the water bottom 8, it should be understood that the subsea mudlift pump 20 and riser outlet/valve 17 may be placed at any intermediate position along the return line 22. Thus, the depth of the subsea mudlift pump 20 in the body of water 1 is not a limitation on the scope of the present invention.

The volume of fluid flowing into and out of the tank 26 is typically monitored, making it possible to determine, e.g., whether drilling fluid is being lost into an exposed formation (i.e., one not sealed by the liner 14), or whether gas or liquid is flowing from an exposed formation and into the wellbore 15 and fluid circulation system.

As explained in the Background section herein, most pumps that perform the function of the subsea mudlift pump 20 shown in FIG. 1 are either constant lift/constant head in the form of a centrifugal pump or are positive displacement pumps operated by hydraulic pressure. In the present example, it is typical for the space above the fluid level in the riser 12 (shown by $H_2$ in FIG. 1) to be filled with air.

Although most of the drilling fluid is returned to the platform 4 using the subsea mudlift pump 20, because the annular space in the riser 12 is open to the wellbore annulus 30 in the present embodiment, it is possible for some natural gas, which may include combustible compounds such as methane, butane and propane, for example, to enter the riser 12 by flotation of small bubbles thereof. If sufficient concentration of such combustible gases collects in the riser 12, an explosive mixture with the air therein above the drilling fluid level ($H_1$) may exist.

Figure 2:
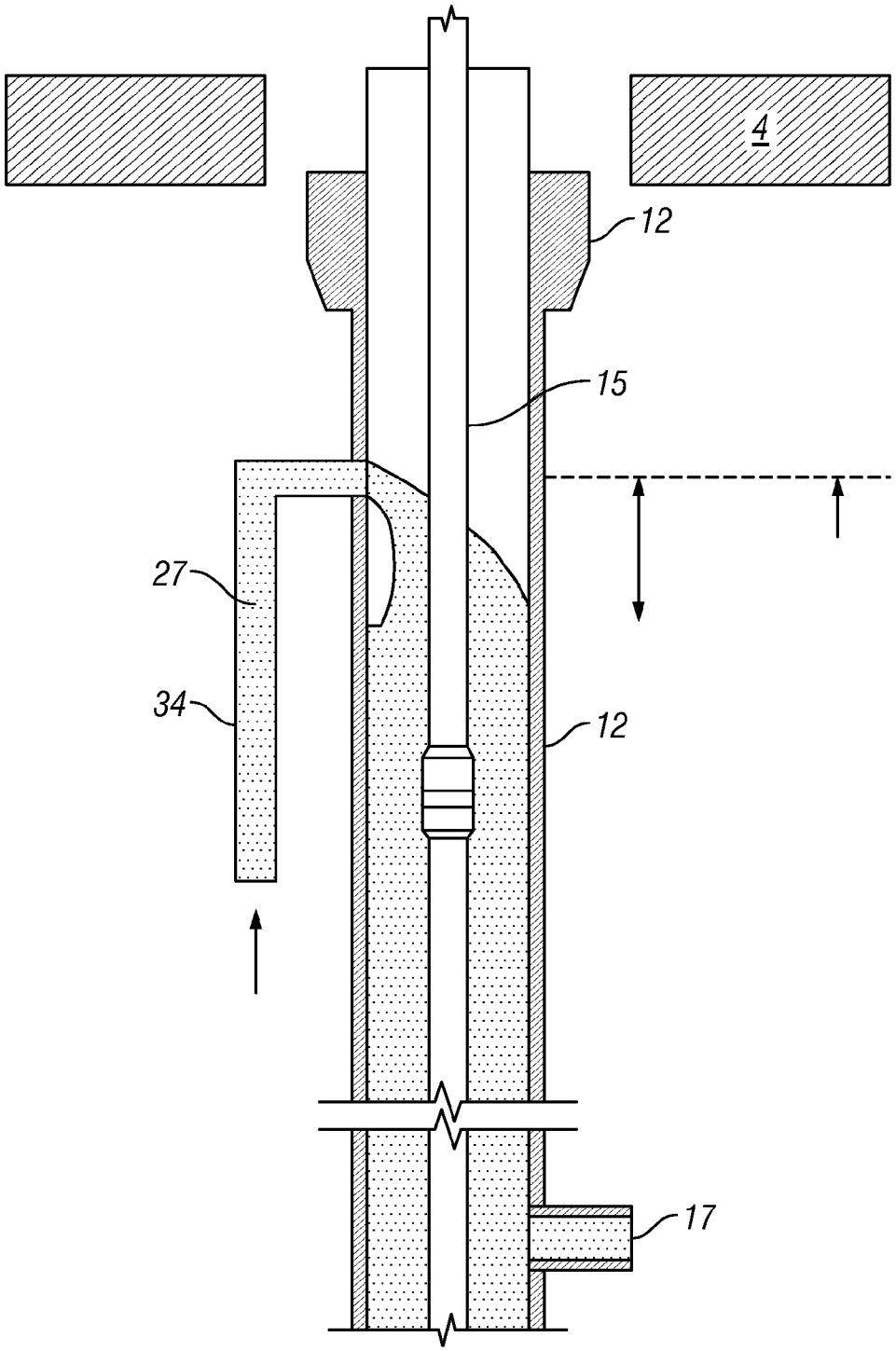
FIG. 2 shows one example of components used to introduce fluid into the riser above the maintained fluid level of the system to inhibit an explosive atmosphere in the upper part of the riser.

Referring to FIG. 2, one example of a system and method for inhibiting an explosive mixture in the upper part of the riser 12 (i.e., at the $H_1/H_2$ interface level to the platform 4 in FIG. 1) will now be explained.

Fluid, for example the drilling fluid 27 may be introduced through a port 34, line, or similar entry point into the upper portion of the riser 12. The drilling fluid 27 may be introduced by diverting part of the output of the rig pumps (32 in FIG. 1) or by a separate pump (not shown). The rate at which the drilling fluid 27 is introduced may be selected with a corresponding increase in the flow rate of the subsea pump (20 in FIG. 1) to create a downward flow of the drilling fluid in the riser 12 while maintaining the drilling fluid level at the selected height ($H_1$ in FIG. 1) or a selected inlet pressure to the subsea mudlift pump (20 in FIG. 1). The downward flow rate so generated may be selected to minimize or stop accumulation of gases from the subsurface formations (in the returning mud in the annulus 30 in FIG. 1) in the upper part of the riser (i.e., at the $H_1/H_2$ interface up to the surface). The introduction of liquid drilling mud proximate the upper end of the riser 12 may also serve to inhibit propagation of a flame front in the event an ignition source begins combustion of an explosive mixture of gases that may have accumulated in the upper part of the riser 12, thus preventing an explosive event from occurring. For purposes of the present description, "inhibiting" an explosive atmosphere may include both substantially eliminating accumulation of an explosive concentration of wellbore gas in the portion of the riser 12 above the mud/air interface (the "upper part" of the riser as described above), and/or inhibiting propagation of a flame front in the event of ignition of a gas/air mixture by introducing drilling mud proximate the top of the riser 12.

Calculation of the downward flow rate needed to stop upward propagation of formation gas bubbles may be explained as follows:

Two approaches have been considered; momentum analysis and gas slip velocity analysis. In the momentum analysis, momentum of flowing gas is first calculated and then the required mud momentum to overcome the gas momentum is calculated. In the gas slip velocity analysis, the fill rate of drilling fluid into the upper part of the riser 12 required to establish enough downward annular velocity to surpass gas slip velocity is be calculated. To do so, the gas slip velocity must first be estimated.

The rising gas in the annulus of the riser 12 has a momentum which depends on the gas rate, gas specific gravity, temperature of the gas, gas pressure, and cross sectional area of the riser annulus. The gas will be pushed back down the riser toward the riser outlet if the drilling mud inside the riser flows against the slipping gas with a high enough momentum. Momentum of drilling mud depends on its density, flow rate, and cross sectional area of the riser annulus. The flow rate required to achieve the required momentum is described herein below.

For the example gas momentum analysis below, it is assumed that the riser outlet is 400 m (about 1,312 feet) below the flow line on the drilling platform (4 in FIG. 1) and that the mud level inside the riser is kept at about 1 meter (3.28 ft) below the flow line (FIG. 1) by the subsea mudlift pump (20 in FIG. 1). It should be emphasized here that these height figures are for example analysis purposes only, and do not limit the scope of the present disclosure with respect to locations of the various riser inlets, outlets pumps and fluid levels. The following scenario has been considered for this analysis in Table 1:

Absolute pressure at the riser outlet is the hydrostatic pressure of the mud above that point plus the atmospheric pressure.

$$P_{(psia)} = \frac{12}{231} \times \mathrm{MW(ppg)} \times H_1(\mathrm{ft}) + 14.503 \quad (1)$$

It has been assumed that the subsea pump (20 in FIG. 1) is operating at a constant inlet pressure as calculated by eq. (1). This means that whatever is pumped into the riser from the top is gathered by subsea pump (20 in FIG. 1) from the riser fluid outlet (17 in FIG. 1).

TABLE 1

| | | | |
|---|---|---|---|
| Mud Height in Marine Drilling Riser (h) | 399 m | 1,309 ft | |
| Mud Density (MW) | 82.29 lb/ft$^3$ | 11 ppg | 1.32 S.G. |
| Pipe Outer Diameter (ODPipe) | 5.5 inch | | |
| Riser Inner Diameter (IDRiser) | 19.5 inch | | |
| Temperature of Mud at the Riser Outlet (T) | 572.67° R | 113° F. | 45° C. |
| Pressure at the Riser Outlet (P) | 109,805 lbf/ft$^2$ | 748 psig (762 psia) | 52.6 bar |
| Molecular Weight of Air (Ma) | 28.97 g/mole | — | — |
| Gravitational Acceleration (gc) | 32.2 lbm-ft/lbf-sec$^2$ | — | — |
| Gas Percolation Rate from the Bottom (q) | 1.11 ft$^3$/sec. | 1900 lpm | 500 gpm |

The following gas has been considered for this analysis:

TABLE 2

Gas Composition

| | | Molecular Weight, g/mole |
|---|---|---|
| Methane | 91.9% | 16.044 |
| Ethane | 6.8% | 30.07 |
| Propane | 0.6% | 44.097 |
| Butane | 0.7% | 58.12 |

TABLE 3

Gas Properties

| | | |
|---|---|---|
| Gas Type | Natural Gas | |
| Calculated Compressibility Factor | 0.98 | |
| Calculated Density ρ | 2.31 lbm/ft3 | 0.31 ppg |
| Molecular Weight (Mg) | 17.46 g/mole | |
| Specific Gravity (Sg) | 0.6 (Mg/Ma = 17.46/28.97) | |

Momentum of gas for the assumed well and drilling unit configuration, gas composition and gas properties is calculated by the following formula:

$$M_{gas}=(\rho q)^2 zTR/S_g M_a \rho g_c A \quad (2)$$

Where A is the cross-sectional area of the riser annulus in cubic feet, R is the universal gas constant, T is the temperature of gas which is assumed to be the temperature of mud at the riser outlet in degrees Rankin, P is the pressure of gas at the riser outlet which is assumed to be the hydrostatic pressure of mud at that point, z is gas compressibility factor at the given temperature and pressure, ρ is density of the gas entering, and q is the gas percolation rate expressed in cubic feet per second, and the remaining parameters and their units have been described in the tables above.

Having calculated the momentum of slipping gas, the momentum of mud pumped into the top of the riser can be readily calculated; the momentum of the downflowing mud must be at least equal to the momentum of the percolating gas calculated by eq. (2) above.

The density of 'killing' mud is known because it is typically the same mud used to drill the well in the proposed system of FIGS. 1 and 2, which allows pumping of the same drilling mud to the riser from the top (which is 11 ppg [pounds per gallon density] mud in this example scenario). Having known density of mud and magnitude of momentum required to push the slipping gas back to the riser outlet, the mud fill rate can be calculated by the following equation:

$$q=\sqrt{M_{mud} g_c/\rho} \quad (3)$$

in which $M_{mud}$ is the momentum of the mud and $g_c$ is the gravitational acceleration.

For the assumed scenario in the present example, 85 gpm (2 bbls/min) flow rate of 11 ppg mud may develop enough momentum to stop the described example gas from moving up the riser. However, the rate of top-fill needs to be higher to establish larger momentum for efficient gas removal from the top portion of mud in the marine drilling riser. 20% more volumetric flow rate (106 gpm=2.5 bbls/min) may be enough for the purpose of gas removal, but higher top-fill rate is still feasible using the described subsea pump (20 in FIG. 1)

For different mud weights, the foregoing analysis would provide almost the same value of riser fill rate. For cases where the level of mud is lower than what assumed in the present example scenario, lower fill rates may be enough to bullhead the upper portion of partially-filled marine drilling riser using the system of FIG. 1 and FIG. 2.

This calculation is excerpted from well control literature (one publication for which is cited below) where normally the amount of gas flow is quite significant. The above described method may give good result if the plan is to kill a well-control-range of gas flow (e.g., on the order 500 gallons per minute [gpm] or about 12 barrels per minute [bbls/min]) as it has been the case for the present example scenario. 12 bbls/min of gas at the riser outlet condition (113 degrees F. and 762 psia) is equivalent to 1.5 bbls/min at downhole conditions (for example; 160 degrees F. and 11,440 psia), which would have required putting the well into the secondary well control measures (e.g., closing the BOP to prevent further fluid entry into the riser).

However, for cases where only slight volumes of gas may release into the upper portion of the riser during normal well operations of the system of FIGS. 1 and 2, the present method might not provide useful results. Below, the problem is analyzed in another way, the so-called "gas slip velocity" approach. By such approach, the gas slip velocity is estimated where the gas flow is not so significant. However, the results of "momentum analysis" may still be valid if, for any reason, high flow rates of gas into the upper portion of the riser occur. The "gas slip velocity approach may be described as follows:

The volume of fluid (e.g., mud) needed to be pumped in the riser proximate the top thereof (or at least above the mud/air interface) must be enough to develop sufficient annular fluid velocity to overcome gas slippage. This it means that the "liquid velocity" established inside the annulus must be higher than the "gas slip velocity". Table 4 shows the volume rate of mud required to be pumped from the top of the riser to push the gas down the riser to the suction outlet for different gas slip velocities. If, for example, gas slip velocity is 5 ft/sec and 20% Removal Factor is required, then according to Table 4, 89 gpm (~2 bbls/min) top-fill rate is required.

TABLE 4

| | Pump Flow Rate (gpm) for removal factor shown in percent | | | | |
|---|---|---|---|---|---|
| Gas Slip Velociy (ft/sec) | 0 | 5 | 10 | 15 | 20 |
| 2 | 29 | 30 | 32 | 34 | 36 |
| 3 | 43 | 45 | 48 | 50 | 54 |
| 4 | 57 | 60 | 63 | 67 | 71 |
| 5 | 71 | 75 | 79 | 84 | 89 |
| 6 | 86 | 90 | 95 | 101 | 107 |
| 7 | 100 | 105 | 111 | 118 | 125 |
| 8 | 114 | 120 | 127 | 134 | 143 |
| 9 | 129 | 135 | 143 | 151 | 161 |
| 10 | 143 | 150 | 159 | 168 | 178 |
| 11 | 157 | 165 | 175 | 185 | 196 |
| 12 | 171 | 180 | 190 | 202 | 214 |
| 13 | 186 | 195 | 206 | 218 | 232 |
| 14 | 200 | 210 | 222 | 235 | 250 |
| 15 | 214 | 225 | 238 | 252 | 268 |
| 16 | 228 | 241 | 254 | 269 | 286 |
| 17 | 243 | 256 | 270 | 286 | 303 |
| 18 | 257 | 271 | 286 | 302 | 321 |
| 19 | 271 | 286 | 301 | 319 | 339 |
| 20 | 286 | 301 | 317 | 336 | 357 |
| 21 | 300 | 316 | 333 | 353 | 375 |
| 22 | 314 | 331 | 349 | 370 | 393 |

Removal Factor (RF), in Table 4 is defined as follows:

$$RF = \frac{V_{mud} - V_{slip}}{V_{mud}} \times 100 \tag{4}$$

where Vmud is the average mud velocity in the annulus of the riser and Vslip is the slip velocity of gas in the mud. The higher the removal factor (RF), the more efficiently gas is removed from the riser. Zero RF means the average mud velocity in the annulus of the riser balances (or is less than) the gas slip velocity, which is not enough for the purpose of gas removal. Therefore, higher RF is needed.

For the example scenario here, in the system of FIGS. 1 and 2, where the equivalent diameter (see Stein et al., 1952) is 18.71 in., it may be inferred that the gas slip velocity mostly depends on the rate at which gas enters the column of drilling fluid. this means that if the density of the drilling fluid, the density of the gas and mud rheology changes from one well to another, such changes will not have considerable effect on the gas slip velocity (Stein et al., 1952). Therefore, if it is possible to predict the gas slip velocity for natural gas within a water column (as the drilling fluid), the result would be similar for other drilling fluids. Such results may be accurate enough to determine the necessary fluid influx rate above the mud/air interface (or at near the top of the riser).

The gas slip velocity for natural gas at a flow rate of 500 gpm inside a 6 inch internal diameter vertical test tube was measured to be 12.5 ft/sec (Stein et al., 1952). In this measurement, the liquid phase was water and the gas was composed of more than 97% methane. This slip velocity was shown empirically to be close to that of other liquids such as lubricating oil and crude oil, which means that the effects of liquid density and viscosity on the slip velocity are relatively minor. According to Stein et al., the gas influx rate and conduit size have the greatest effects on the gas slip velocity at higher gas influx rates.

For the same gas influx rate as above (500 gpm) the gas slip velocity will decrease if the size of the conduit increases (Stein et al., 1952) as is the case for the system shown in FIGS. 1 and 2. Therefore, the gas slip velocity would be far less than 12.5 ft/sec. in the annulus between the riser inner wall and the drill string in the system of FIGS. 1 and 2 which typically has an equivalent diameter of 18.71 in. (3 times larger than the 6 inch test tube used by Stein et al.). For a gas slip velocity of 6 ft/sec, a riser fluid (mud) fill rate of only of 86 gpm (~2 bbls/min) is required to establish an average downward liquid velocity equal to the gas slip velocity. This number matches very well with the momentum analysis described herein above. If a removal factor of 20% is desired, a fill rate of 107 gpm is required. This fill rate also matches very well with the results of momentum analysis. It should be noted that the foregoing slip velocity results match with the momentum analysis results because an assumed a gas slip velocity of 6 ft/sec was used. This number has been obtained by a rough extrapolation of plots generated by Stein et al.; the rough extrapolation may be unreliable.

However, for a slip velocity of 12.5 ft/sec, which is believed to be much higher than may be reasonably expected, a riser fill rate of approximately 200 gpm is sufficient to "bullhead" the top section of riser (above the mud/air interface), according to Table 4. However, it should be emphasized that the foregoing slip velocity is quite overestimated as the gas slip velocity is not that high for a flow rate of 500 gpm in such large diameter conduit (see Stein et al. 1952).

As it has been mentioned before in the momentum analysis portion of this description, 500 gpm (12 bbls/min) gas influx is very significant and under ordinary drilling conditions it is not expected to experience such amount of gas at the riser outlet.

For purposes of the present description, assume a more realistic rate of free gas rate at the riser outlet that may possibly happen due to presence of free or dissolved gas in the mud at the bottom of the hole during normal drilling operations. For example, Assume that 20 gpm of gas at the riser outlet condition (here in our example scenario; 113 degrees F. temperature and 762 psia) pressure escapes from the riser suction outlet (see 17 in FIG. 1) and enters the upper portion of the riser. This amount of gas would be the result of 2.55 gpm of gas influx at bottom hole conditions (for example; 160 degrees F. and 11,440 psia), and assuming that all the gas entering into the wellbore escapes from being removed from the riser by the pump (20 in FIG. 1). According to Stein et al., the mean gas slip velocity corresponding to the 20 gpm (~4 Mcf/Day) of gas injection rate at the riser outlet condition would hardly be more than 2.5 ft/sec. This amount of gas can be pushed back to the riser outlet suction by just 1 bbl/min of top-fill.

For a gas percolation rate of 500 gpm (1,900 lpm), a top-fill rate of 107 gpm (2.5 bpm) is enough to bullhead the top section of the riser in system of FIGS. 1 and 2. A riser fill rate of 200 gpm (4.7 bpm) will certainly keep the mud column above the suction outlet (17 in FIG. 1) clear of any gas, although such fill rate may be more than is required to control gas slippage for gas percolation rates of a maximum of 500 gpm (1,900 lpm). Normally, the gas percolation rate is far less than 500 gpm (1,900 lpm); otherwise, the operation of the drilling system would have switched to the secondary well control procedures, e.g., closing the BOP and instituting well known "kill" procedures.

For a more realistic gas release rate of 20 gpm at the riser outlet (17 in FIG. 1) pressure and temperature conditions, a top-fill rate of 1 bpm is enough to keep the upper portion of riser clear of any gas. This riser fill rate will generate enough downward liquid velocity in the annulus of the riser/drill string to push the gas toward the suction outlet (17 in FIG. 1) so that it is removed out of the riser by the subsea pump (20 in FIG. 1), assuming that the subsea pump is operating at a rate required to remove both the riser fill mud and the returning mud from the wellbore.

Figure 3:
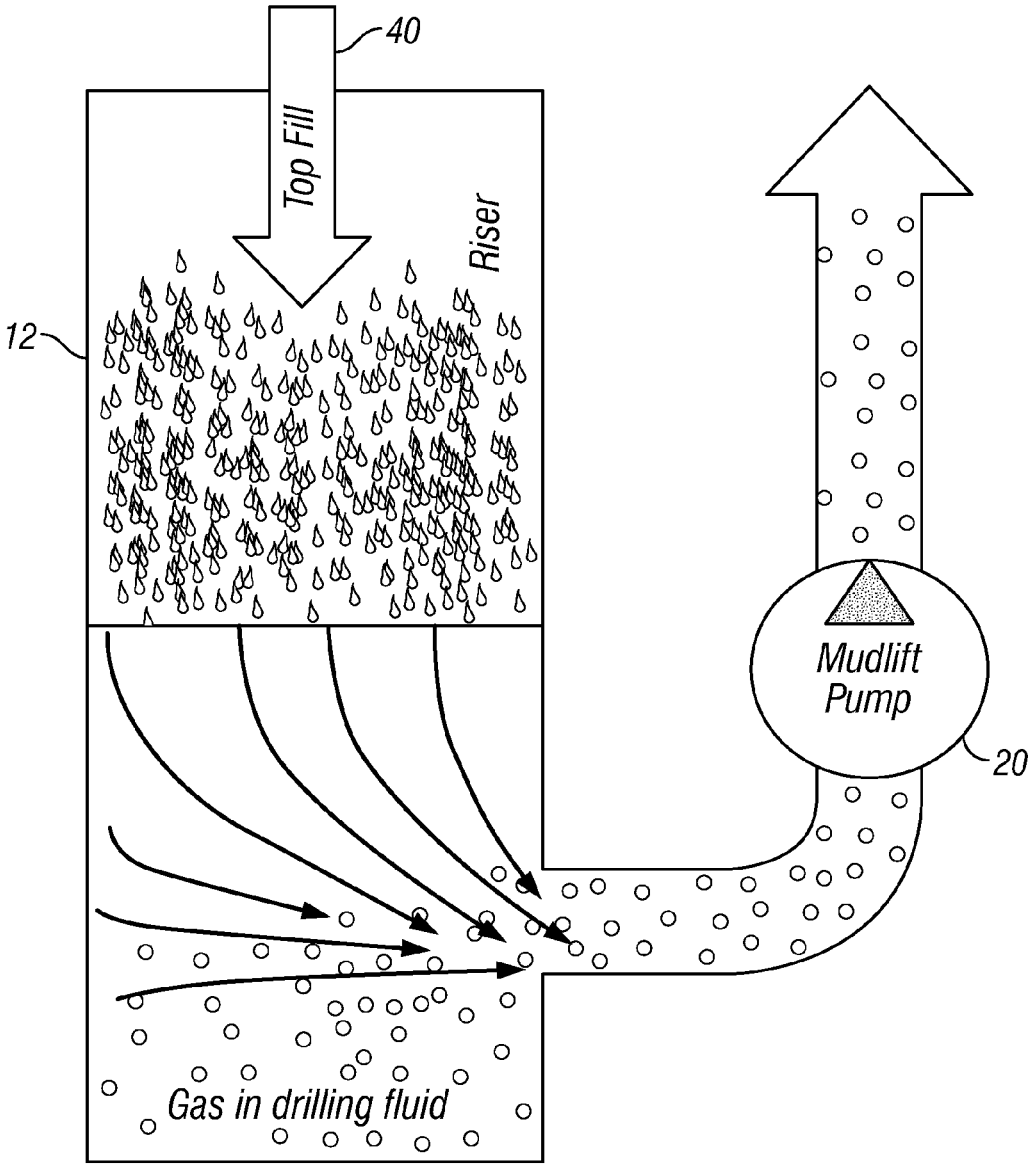
FIG. 3 shows an example of filling the riser from the top.

Another example implementation is shown in FIG. 3, wherein fluid is introduced into the riser 12 at the top end thereof. The subsea mudlift pump returns all fluid, both drilling fluid pumped from the drilling unit, the riser filling fluid and the entrained gas. Velocity of the fluid needed to entrain the gas and return it may be calculated substantially as explained with reference to FIG. 2. Generally, the velocity of fluid moving downwardly is greater than the velocity of rising gas entrained in the riser fluid. The amount of gas may be measured at the surface and removed from the returning fluid.

A system and method according to the various aspects of the invention may inhibit an explosive atmosphere in an open riser wellbore pressure control system where air is used as the riser fluid above the mud column therein.

References cited in the present specification include the following:

(1) Grace, R. D., Cudd, B., Carden, R. S., Shursen J. L., 2003, *Blowout and Well Control Handbook,* 262-270. Gulf Professional Publishing.

(2) Stein, N., Elfrink, E. B., Wiener, L. D. and Sandberg, C. R., 1952, *The Slip Velocity of Gases Rising through Liquid Columns,* 233-240; Trans., AIME.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A method for inhibiting an explosive atmosphere in a wellbore drilling system including a riser connected to a wellbore above a top thereof, the riser having a fluid outlet below a surface of a body of water in which the wellbore is drilled, the fluid outlet connected to a subsea pump to return drilling fluid to a drilling platform on the water surface, the pump operated to maintain a selected drilling fluid level in the riser or a selected wellbore pressure, a space in the riser above the drilling fluid level filled with air, the method comprising:

pumping drilling fluid into a drill string extending from the drilling platform, through the riser, into the wellbore;

introducing fluid from a position above the drilling fluid level into an annular volume of the space in the riser above the drilling fluid level situated between the riser and the drill string extending therethrough, a rate of introducing the fluid selected to generate sufficient downward velocity of fluid in the riser so as to substantially stop upward movement of gas in the riser, thereby inhibiting an explosive atmosphere in the space in the riser above the drilling fluid level; and operating the subsea pump during the introducing fluid to remove fluid from the riser outlet at a rate selected to maintain the fluid level or the selected wellbore pressure and maintain the downward velocity of fluid in the riser.

2. The method of claim 1 wherein the introduced fluid comprises drilling fluid.

3. The method of claim 2 wherein a rate of introducing the fluid is selected to create a downward fluid velocity in the riser below the fluid level such that a momentum of downwardly moving drilling fluid is at least equal to an upward momentum of gas entering the riser from the wellbore.

4. The method of claim 2 wherein a rate of introducing the fluid is selected to create a downward fluid velocity in the riser below at least equal to a slip velocity of gas entering the riser from the wellbore.

* * * * *